US007959497B2

(12) United States Patent
Guenther et al.

(10) Patent No.: US 7,959,497 B2
(45) Date of Patent: Jun. 14, 2011

(54) HAND-HELD POWER TOOL WITH LOCKING NUT

(75) Inventors: Joachim Guenther, Kaufering (DE); Klaus Nagelschmied, Germering (DE); Friedemann Moeller, Munich (DE); Roland Meuer, Ettringen (DE); Thomas Blatz, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 350 days.

(21) Appl. No.: 12/316,545

(22) Filed: Dec. 11, 2008

(65) Prior Publication Data

US 2009/0156107 A1 Jun. 18, 2009

(30) Foreign Application Priority Data

Dec. 12, 2007 (DE) ..... 10 2007 055 777

(51) Int. Cl.
*B24B 23/00* (2006.01)

(52) U.S. Cl. ..... 451/359; 451/508

(58) Field of Classification Search ..... 451/359, 451/508, 509

See application file for complete search history.

(56) References Cited

U.S. PATENT DOCUMENTS

| | | | | |
|---|---|---|---|---|
| 2,331,861 | A * | 10/1943 | Smith | 451/509 |
| 2,747,343 | A * | 5/1956 | Gellert | 451/342 |
| 6,116,996 | A * | 9/2000 | Yanase | 451/359 |
| 2003/0096566 | A1 * | 5/2003 | Fritz et al. | 451/508 |

* cited by examiner

*Primary Examiner* — Robert Rose

(74) *Attorney, Agent, or Firm* — Abelman, Frayne & Schwab

(57) ABSTRACT

A hand-held power tool includes a drive spindle (2) rotatable about a rotational axis (A), a clamping flange (3) provided at a free end of the drive spindle (2) and having at least one inner thread (12) that in a mounted condition of the clamping flange (3) on the drive spindle (2), engages in a thread undercut (13) of the clamping flange (2), a locking pin likewise provided at the free end of the drive spindle (2) and having a locking thread (4), and a locking nut (7) tightenable on the locking thread (4) for securing a disc-shaped tool (5) between the clamping flange (3) and the clamping surface (6) of the locking nut (7), with the clamping flange (3) having in its axial region between the disc-shaped tool (5) and an inner recess (8) of the locking nut (7) in which the centering collar (9) of the clamping flange (3) can be partially received at least one radial, outwardly projecting nose (10), and with the disc-shaped tool (5) having at least one, opening radially inwardly and axially extending groove (11) associated with the at least one nose (10) of the clamping flange.

3 Claims, 1 Drawing Sheet

HAND-HELD POWER TOOL WITH LOCKING NUT

BACKGROUND OF THE INVENTION

1. Field of the Invention

The present invention relates to a hand-held power tool with a locking nut for securing a disc-shaped tool and, in particular, to angle grinder, hand-held jointer saw, or hand-held circular saw.

2. Description of the Prior Art

Conventional tool holders for a disc-shaped tool (under which in addition to flat discs, also plate-shaped tools are understood) frictionally secure the disc-shaped tool on the rotatable drive spindle between a clamping flange provided on the drive spindle and a locking nut that is screwed onto the drive spindle. The thread direction of the locking thread provided on the drive spindle is usually so selected that the locking nut automatically tightens upon actuation of the power tool or start up of the operation.

Contemporary hand-held power tools with safety routines provide for sudden braking of the drive spindle up to a complete stop. In order to reliably prevent an inadvertent loosening of the locking nut and/or of the disc-shaped tool in case when the locking nut becomes loose due to its inertia upon a sudden stop of the spindle, German Publication DE 42 38 466 discloses locking means that in addition to a locking nut, includes additional clamping means that applies pressure to the disc-shaped tool and is preloaded against a locking nut with a plate spring.

According to International Publication WO 98/43779, the clamping flange forms axially and radially extending rotation-transmitting elements that engage formlockingly in associated axial recesses of a disc-shaped tool and which open radially inwardly.

An object of the present invention is to provide a reliable tool holder for a disc-shaped tool and that includes a locking nut.

SUMMARY OF THE INVENTION

This and other objects of the present invention, which will become apparent hereinafter are achieved by providing a hand-held power tool including a drive spindle rotatable about a rotational axis, a clamping flange provided at a free end of the drive spindle and having a centering collar and at least one inner thread that in a mounted condition of the clamping flange on the driver spindle, engages in a thread undercut of the clamping flange, a locking pin likewise provided at the free end of the drive spindle and having a locking thread and a locking nut having an inner recess in which the centering collar of the clamping flange can be partially received, and a clamping surface and tightenable on the locking thread for securing a disc-shaped tool between the clamping flange and the clamping surface of the locking nut. The clamping flange has, in its axial region between the disc-shaped tool and the inner recess of the locking nut, at least one, radially, outwardly projecting nose, with the disc-shaped tool having at least one, opening radially inwardly and axially extending groove associated with the at least one nose of the clamping flange.

With a radially projecting nose on the clamping flange, the disc-shaped tool can be removed away from the clamping flange only in its precise associated circumferential position, and, in particular, not in inertia-induced rotational condition relative to the drive spindle. The at least one inner thread of the clamping flange prevents the clamping flange from being detached from the drive spindle. Thus, the disc-shaped tool is axially secured on the drive spindle even in the case when the locking nut would have become loose on the drive spindle due to inertia.

Advantageously, the clamping flange is formed of steel, which provides for the high load-bearing capacity of the clamping flange.

Advantageously, the clamping flange has two opposite, projecting radially outwardly noses. Thereby, the associated disc-shaped tool can be ergonomically mounted/dismounted in at least two circumferential positions.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
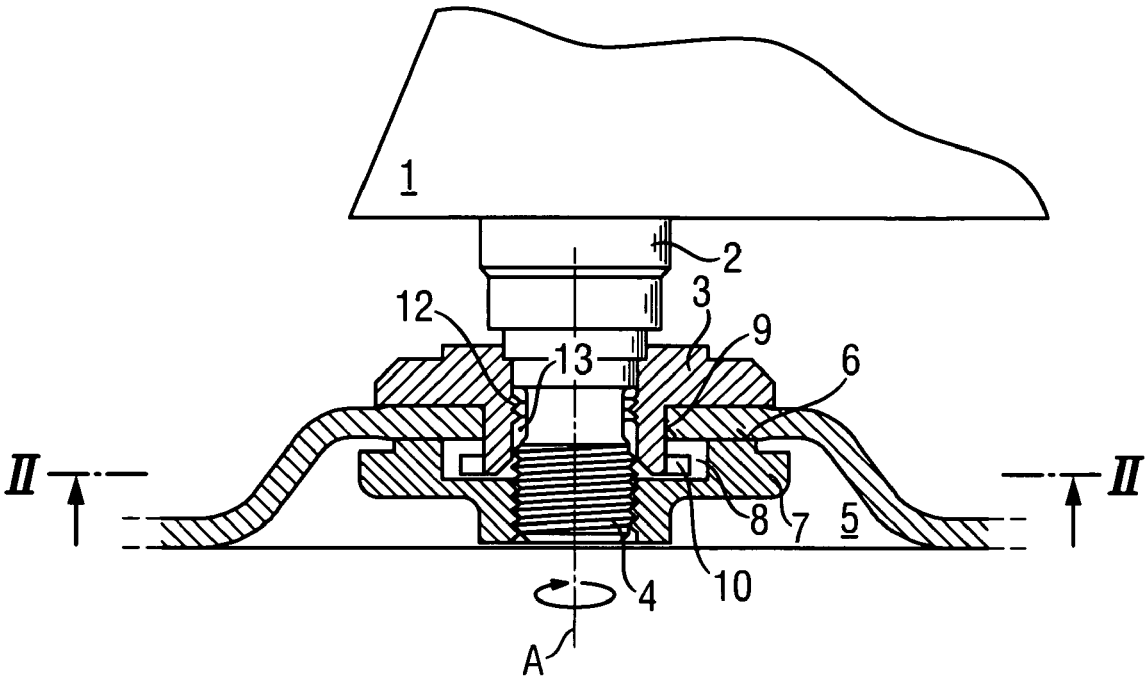
FIG. 1 a longitudinal cross-sectional view illustrating securing of a disc-shaped tool to a hand-held power tool.

A hand-held power tool 1, which schematically shown in FIG. 1, includes a drive spindle 2 rotatable about a rotational axis A, a clamping flange 3 formlockingly secured on an end of the drive spindle 2, and a locking thread 4. A disc-shaped tool 5 in form of a grinding disc is secured at the end of the drive spindle 2 with a clamping surface 6 of a locking nut 7 that is tightened on the locking thread 4. A clamping flange 3 has a centering collar 9 partially receivable in an inner recess 8 of the locking nut 7. An end surface of a section inner recess 8 of the locking nut 7, is provided with two, projecting radially outwardly noses 10. The clamping flange 3 further has two inner threads 12 engaging in a threaded undercut 13 of the drive spindle 2.

Figure 2:
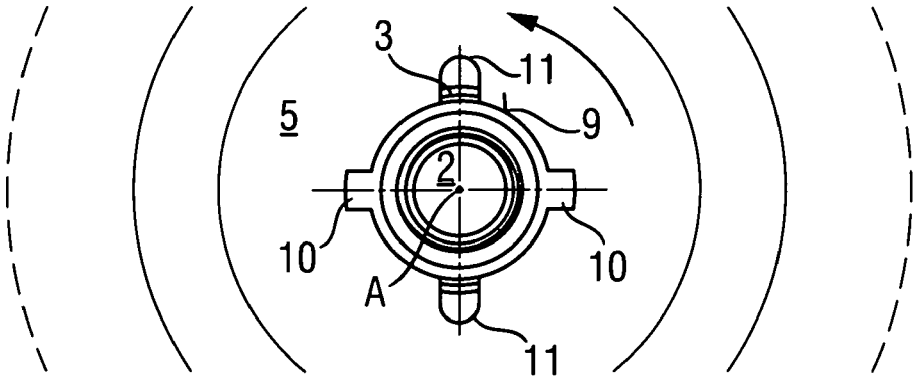
FIG. 2 an axial bottom view in direction of line II-II of the disc-shaped tool with a loose locking nut.

As shown in FIG. 2, the disc-shaped tool 5, which is shown only partially in FIG. 2, has two diametrically opposite, opening radially inwardly, axially extending grooves 11 associated with the two noses 10. In the inertia-induced, freely rotatable, about the rotational axis A, condition of the disc-shaped tool 5 shown in FIG. 3, the grooves 11 are not exactly aligned with noses 10 of a stationary clamping flange 3 supported on the drive spindle 2 without a possibility of rotation relative thereto, in a plurality of angular positions after a quick stop of the power tool, so that the disc-shaped tool 5 does not change its axial position on the stationary drive spindle 2.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held power tool, comprising a drive spindle (2) rotatable about a rotational axis (A) and having a threaded undercut (13); a clamping flange (3) provided at a free end of the drive spindle (2) and having a centering collar (9), and at least one inner thread (12) that in a mounted condition of the clamping flange (3) on the drive spindle (2), engages in the threaded undercut (13) of the drive spindle (2); a locking pin likewise provided at the free end of the drive spindle (2) and having a locking thread (4); and a locking nut (7) having an inner recess (8) in which the centering collar (9) of the clamping flange (3) can be partially received, and a clamping surface (6) and tightenable on the locking thread (4) for securing a disc-shaped tool (5) between the clamping flange (3) and the clamping surface (6) of the locking nut (7), wherein the clamping flange (3) has, in an axial region thereof between the disc-shaped tool (5) and the inner recess (8) of the locking nut (7), at least one, radially, outwardly projecting nose (10), and the disc-shaped tool (5) has at least one, opening radially inwardly and axially extending groove (11) associated with the at least one nose (10) of the clamping flange.

2. A hand-held power tool according to claim 1, wherein the clamping flange (3) is formed of steel.

3. A hand-held power tool according to claim 1, wherein clamping flange (3) has two opposite, outwardly projecting noses (10).

* * * * *